US005173687A

United States Patent [19]

Tanaka et al.

[11] Patent Number: 5,173,687

[45] Date of Patent: Dec. 22, 1992

[54] METHOD FOR IMPROVING THE GRADATIONAL DISPLAY OF AN ACTIVE TYPE LIQUID CRYSTAL DISPLAY UNIT

[75] Inventors: Sakae Tanaka; Toshio Kashiwa; Yoshiaki Watanabe, all of Tokyo, Japan

[73] Assignee: Seikosha Co., Ltd., Tokyo, Japan

[21] Appl. No.: 762,783

[22] Filed: Sep. 19, 1991

Related U.S. Application Data

[63] Continuation of Ser. No. 369,788, Jun. 21, 1989, abandoned.

[30] Foreign Application Priority Data

Jun. 22. 1988 [JP] Japan ..... 63-154197

[51] Int. Cl.[5] ..... G09G 3/36

[52] U.S. Cl. ..... 340/784; 340/805

[58] Field of Search ..... 340/718, 719, 784, 783, 340/802, 805, 793; 359/54, 53; 358/236, 241

[56] References Cited

U.S. PATENT DOCUMENTS

| | | | |
|---|---|---|---|
| 4,386,352 | 5/1983 | Nonomura et al. | 340/719 |
| 4,393,380 | 7/1983 | Hosokawa et al. | 340/784 |
| 4,586,039 | 4/1986 | Nonomura et al. | 340/784 |
| 4,680,580 | 7/1987 | Kawahara | 340/719 |
| 4,928,095 | 5/1990 | Kawahara | 340/784 |

*Primary Examiner*—Alvin E. Oberley
*Assistant Examiner*—Chanh Nguyen
*Attorney, Agent, or Firm*—Jordan and Hamburg

[57] ABSTRACT

A method of driving an active matrix type liquid crystal display unit of the type including a plurality of liquid crystal layers, a plurality of switching elements, a plurality of pixel electrodes each connected between a liquid crystal layer and a switching element, a common electrode connected to the liquid crystal layers, a plurality of stick capacitive elements each connected to a pixel electrode, and a plurality of scanning lines each connected to a switching element, the method including the steps of selectively turning on the switching elements by applying selection signals to the scanning signal lines of the active matrix type liquid crystal display unit; supplying picture signals to picture signal lines connected with the pixel electrodes through the switching elements; and providing an alternating voltage as an integral fraction of a horizontal interval of a picture frame as at least a common voltage at the common electrode and/or a stick capacitor voltage supplied to the capacitive elements, so as to provide that the ratio of the change in liquid crystal light transmittance T to the change in picture signal voltage $V_{SIG}$ is smaller than the ratio of the change in liquid crystal light transmittance T to the change in effective voltage applied to a respective liquid crystal layer.

14 Claims, 10 Drawing Sheets

METHOD FOR IMPROVING THE GRADATIONAL DISPLAY OF AN ACTIVE TYPE LIQUID CRYSTAL DISPLAY UNIT

This application is a continuation of application Ser. No. 07/369,788, filed Jun. 21, 1989, now abandoned.

BACKGROUND OF THE INVENTION

This invention relates to a method of driving an active matrix type liquid crystal display unit.

Research and development of active matrix type liquid crystal display units in various fields have been conducted for the purpose of applying the technology to thin or flat television sets and the like.

An equivalent circuit diagram of the foregoing active matrix type liquid crystal display unit will now be described with respect to FIG. 3. In this drawing, $SW_i$-$SW_{i+1}$ designate switching elements made of transistors or the like, which are selected (turned on) and non-selected (turned off) in accordance with signals sent to scanning signal lines $XL_i$,$XL_{i+1}$. $YL_j$,$YL_{j+1}$ designate picture signal lines for supplying picture signals to pixel electrodes $PX_i$,$PX_{i+1}$ connected with the selected switching elements $SW_i$,$SW_{i+1}$. $LC_i$,$LC_{i+1}$ designate liquid crystal layers corresponding to individual pixels which are sandwiched by the pixel electrodes $PX_i$,$PX_{i+1}$ and a common electrode COMON. $ST_i$,$ST_{i+1}$ designate stick capacitors connected with the pixel electrodes $PX_i$,$PX_{i+1}$, which are provided for holding individual voltages supplied from the picture signal lines $YL_j$,$YL_{j+1}$. STACK designates a stick capacitor electrode for the stick capacitors $ST_i$,$ST_{i+1}$.

FIG. 9 is a time chart showing a method of driving the active matrix type liquid crystal display unit shown in FIG. 3. In this drawing, $X_i$,$X_{i+1}$ designate scanning signals applied to the scanning signal lines $XL_i$,$XL_{i+1}$, with the value of logic level "1" indicating "selection" and with the value of logic level "0" indicating "non-selection." Specifically, a selection signal of logic level "1" is supplied during a horizontal interval $T_H$ per vertical interval $T_V$. $Y_j$ designates a picture signal applied to the picture signal line $YL_j$, whose polarity is inverted about a reference voltage $V_C$ per vertical interval $T_V$. This alternating-current drive mode is adopted for the purpose of preventing direct current from being applied to the liquid crystal. COM designates a common voltage applied to the common electrode COMON, which is always maintained at the reference voltage $V_C$. PXL designates a pixel voltage applied to the pixel electrode $PX_i$. In this connection, the stick capacitor $ST_i$ holds the value of the picture signal $Y_j$ supplied to the pixel electrode $PX_i$ when the switching element $SW_i$ is selected, even when the switching element $SW_i$ is brought into the "non-selection" mode. PXL-COM designates the signal of the pixel voltage PXL minus the common voltage COM, i.e., the voltage applied to the liquid crystal layer $LC_i$, which has the same waveform as that of the pixel voltage PXL because the common voltage has a constant value $V_C$. It should be noted that the voltage applied to the stick capacitor electrode STACK has the constant value $V_C$.

FIG. 10 shows a light transmittance characteristic of the liquid crystal obtained in accordance with the foregoing driving method. In this drawing, the abscissa represents the effective voltage $V_{LC}$ applied to the liquid crystal layer and the picture signal voltage $V_{SIG}$, whereas the ordinate represents the liquid crystal light transmittance T. According to the foregoing driving method, as described above, the voltage (PXL-COM) applied to the liquid crystal layer has a constant value $V_{SIG}$ because the common voltage COM is constant. Thus, its effective voltage is also "$V_{SIG}$". Therefore, the effective voltage $V_{LC}$ applied to the liquid crystal layer is identical with the picture signal voltage $V_{SIG}$.

However, with such an active matrix type liquid crystal display unit, a gradational display is made by segmenting the span from 100% (white) to 0% (black) of the liquid crystal light transmittance T. Practically, the gradational display is attained by dividing the picture signal voltage $V_{SIG}$ so as to correspond to discrete values of light transmittance. Therefore, to obtain a fine gradational display, the voltage width of the picture signal voltage $V_{SIG}$ corresponding to where the light transmittance T varies from 100% to 0% must be large. Consequently, the ratio of the change in liquid crystal light transmittance $\Delta T$ to the change in picture signal voltage $\Delta V_{SIG}$ must be made as small as possible. According to the foregoing driving method, however, the picture signal voltage $V_{SIG}$ is completely identical with the effective voltage $V_{LC}$ applied to the liquid crystal layer. Therefore, if the effective voltage applied to the liquid crystal layer is $\Delta V_{LC}$, the following expression is obtained:

$$\Delta T/\Delta V_{SIG}=\Delta T/\Delta V_{LC}.$$

Since the range of the effective voltage $V_{LC}$ applied to the liquid crystal layer corresponding to where the light transmittance varies from 100% to 0% is generally as small as a few volts, it is difficult to make the foregoing ratio of $\Delta T/\Delta V_{SIG}$ small. Thus, the foregoing driving method could hardly realize a sufficient gradational display.

SUMMARY OF THE INVENTION

The present invention has been devised in view of the foregoing problems of the prior art. It is therefore an object of the present invention to provide a method of driving an active matrix type liquid crystal display unit which is capable of attaining a sufficient gradational display.

To achieve the foregoing object, the present invention provides a method of driving an active matrix type liquid crystal display unit having stick capacitors, in which an alternating voltage is used as a common voltage and/or a stick capacitor voltage such that, within a given range of liquid crystal light transmittance, the ratio of the change in liquid crystal light transmittance $\Delta T$ to the change in picture signal voltage $\Delta V_{SIG}$ becomes smaller than the ratio of the change in liquid crystal light transmittance $\Delta T$ to the change in effective voltage applied to the liquid crystal layer $\Delta V_{LC}$.

It is preferable that the period of the alternating voltage be an integral multiple or integral fraction of a horizontal interval and further that the period of the alternating voltage be no longer than the period of a vertical interval.

DESCRIPTION OF THE PREFERRED EMBODIMENTS

Embodiments of the present invention will now be described with reference to the drawings.

Figure 3:
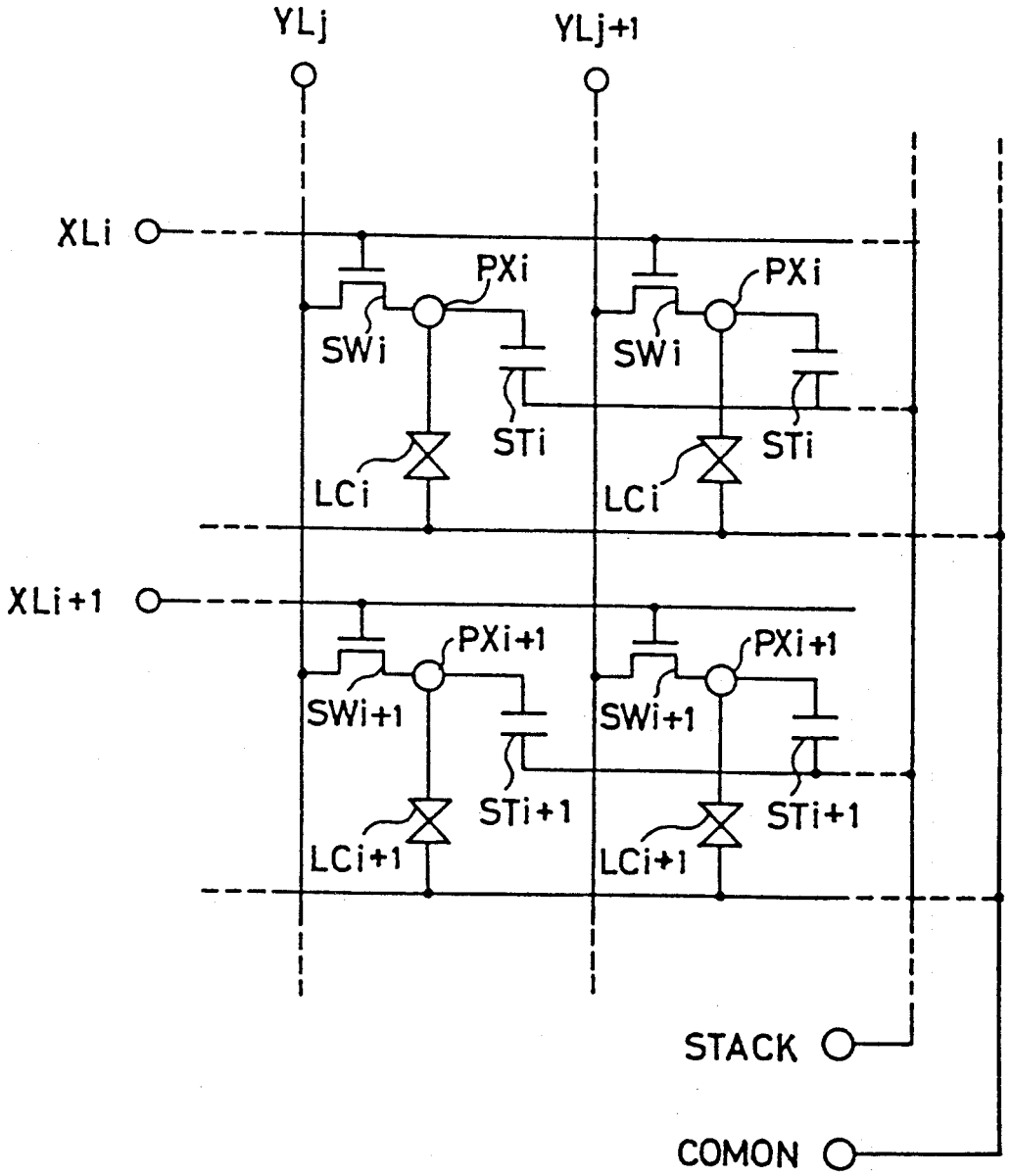
FIG. 3 PRIOR ART
FIG. 3 is an electric circuit diagram showing a portion of an active matrix type liquid crystal display unit with which the present invention can be used.

For convenience, FIG. 3 showing the equivalent circuit of the active matrix type liquid crystal display unit will again be referred to hereinafter.

EMBODIMENT 1

Figure 1:
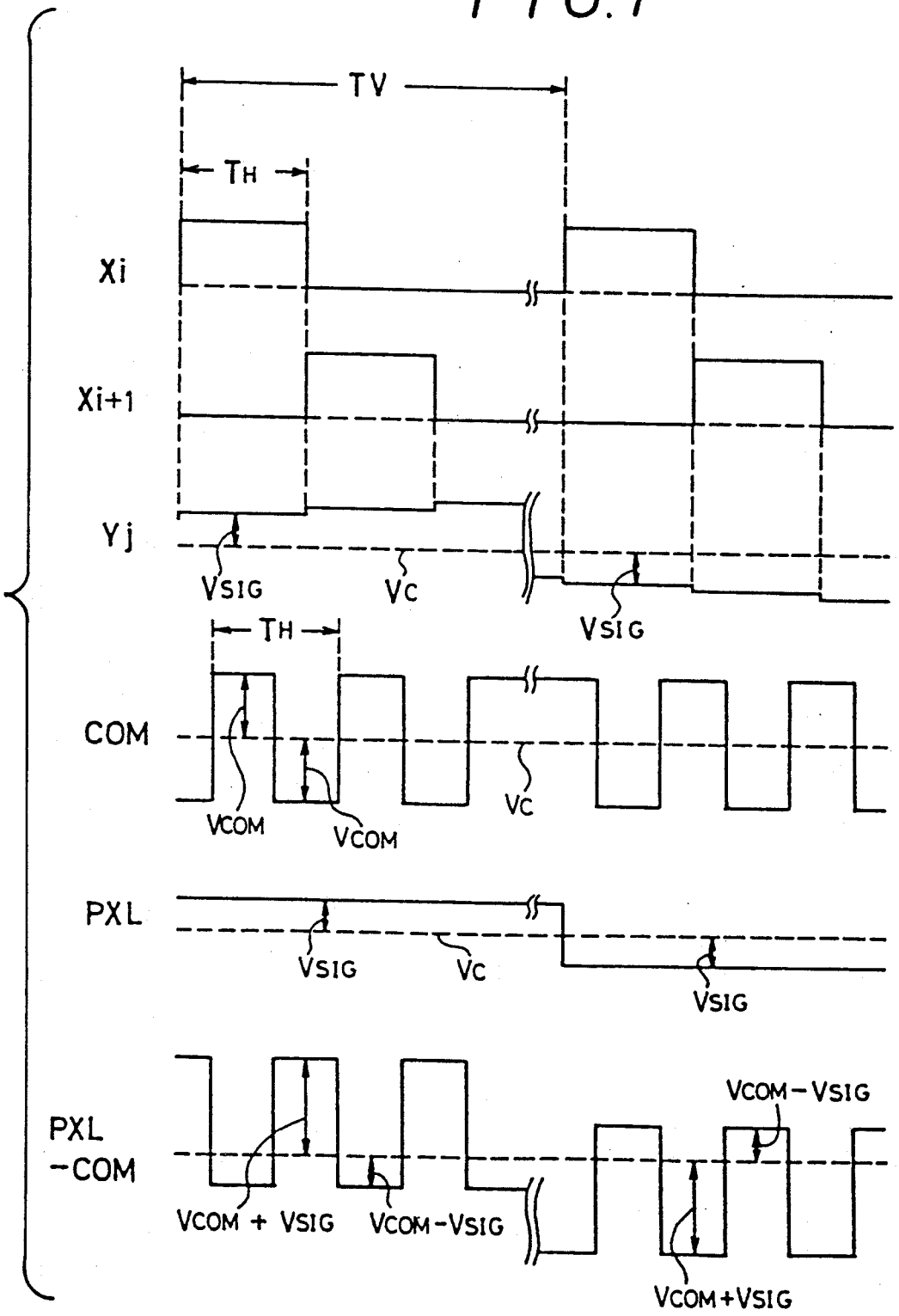
FIG. 1 is a time chart showing waveforms of signals according to a first embodiment of the present invention.

In FIG. 1, $X_i$,$X_{i+1}$ designate scanning signals applied to the scanning signal lines $XL_i$,$XL_{i+1}$, with the value of logic level "1" indicating "selection" and with the value of logic level "0" indicating "non-selection." Specifically, a selection signal of logic level "1" is supplied during a horizontal interval $T_H$ per vertical interval $T_V$. $Y_j$ designates a picture signal applied to the picture signal line $YL_j$, whose polarity is inverted about a reference signal $V_C$ per vertical interval $T_V$. COM designates a common voltage applied to the common electrode COMON, which is an alternating voltage having an amplitude $V_{COM}$ that alternates about the reference voltage $V_C$ at a period identical with that of the horizontal interval $T_H$. PXL designates a pixel voltage applied to the pixel electrode $PX_i$. PXL-COM designates the signal of a stick capacitor voltage PXL minus the common voltage COM, i.e., the voltage applied to the liquid crystal layer $LC_i$. It should be noted that the voltage of the stick capacitor electrode STACK has a constant value $V_C$.

As will be appreciated, when the scanning signal $X_i$ is in the state of non-selection, i.e., when the switching element $SW_i$ is OFF, the liquid crystal layer $LC_i$ and the stick capacitor $ST_i$ are connected in series between the common electrode COMON and the stick capacitor electrode STACK with the pixel electrode $PX_i$ serving as a connecting point. If the capacitance of the liquid crystal layer is $C_{LC}$ and the capacitance of the stick capacitor is $C_{ST}$, and assuming that the voltage of the common electrode COMON and the voltage of the stick capacitor electrode STACK change by values $\Delta V_{COM}$ and $\Delta V_{STK}$, respectively, to cause a change $\Delta V_{PX}$ in the voltage of the pixel electrode $PX_i$, then the following relationship holds:

$$\Delta V_{PX}=\Delta V_{COM}\cdot C_{LC}/(C_{LC}+C_{ST})+\Delta V_{STK}\cdot C_{ST}/(C_{LC}+C_{ST}) \quad (1)$$

This first embodiment of the present invention represents the case where the capacitance $C_{LC}$ of the liquid crystal layer is negligibly small compared with the capacitance $C_{ST}$ of the stick capacitor, i.e., $C_{LC}<<C_{ST}$, to cause no change in the voltage of the stick capacitor electrode STACK, i.e., $\Delta V_{STK}=0$. In this case, therefore, the pixel voltage PXL of the pixel electrode $PX_i$ does not change even if the common voltage COM of the common electrode COMON changes, i.e., $\Delta V_{PX}=0$ in expression (1). Accordingly, the voltage PXL-COM applied to the liquid crystal layer $LC_i$ is that shown in the drawing. Further, the effective voltage in this case is given by:

$$\begin{aligned} V_{LC} &= [\{(V_{COM}+V_{SIG})^2+(V_{COM}-V_{SIG})^2\}/2]^{\frac{1}{2}} \\ &= (V_{COM}^2+V_{SIG}^2)^{\frac{1}{2}} \end{aligned} \quad (2)$$

this being different from the picture signal voltage $V_{SIG}$.

Figure 2:
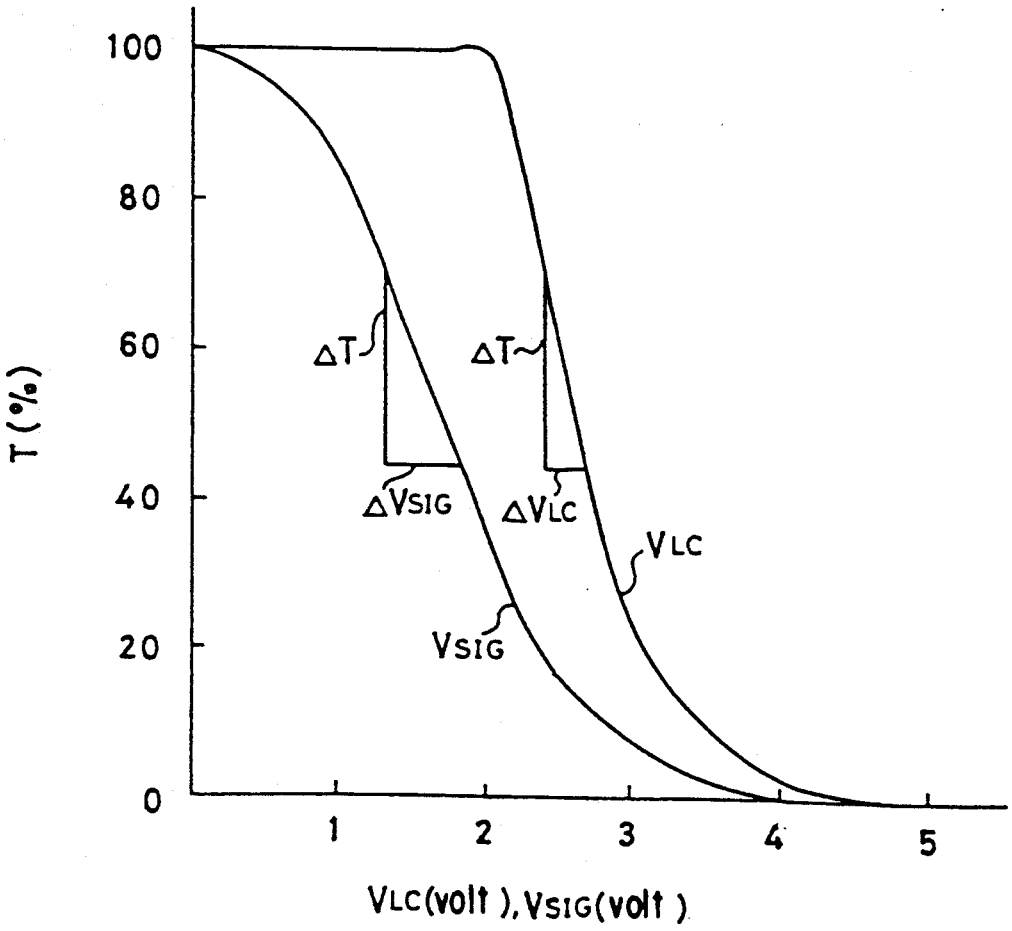
FIG. 2 is a transmittance characteristic graph of a liquid crystal display that is obtained with the signals according to the first embodiment of the present invention.

FIG. 2 shows the light transmittance characteristic of the liquid crystal layer obtained using the foregoing driving method. In this drawing, the abscissa represents the effective voltage $V_{LC}$ applied to the liquid crystal layer and the picture signal voltage $V_{SIG}$, whereas the ordinate represents the liquid crystal light transmittance T. This characteristic was obtained by taking the amplitude $V_{COM}$ of the common voltage COM to be 2 volts, modifying expression (2), and calculating the voltage $V_{SIG}$ from the value of $V_{LC}$. As will be appreciated from this drawing, although the change of effective voltage $V_{LC}$ applied to the liquid crystal layer where the light transmittance of the liquid crystal layer varies from 100% to 0% is about 2 volts, the change of picture signal voltage $V_{SIG}$ becomes as large as about 4 volts. At the same time, the ratio of the change in liquid crystal light transmittance $\Delta T$ to the change in picture signal voltage $\Delta V_{SIG}$ becomes smaller than the ratio of the change in liquid crystal light transmittance $\Delta T$ to the change in effective voltage applied to the liquid crystal layer $\Delta V_{LC}$, substantially over the whole range of light transmittance.

As will be appreciated from the above, the foregoing driving method can make the value of $\Delta T/\Delta V_{SIG}$ small to attain a sufficient gradational display.

EMBODIMENT 2

Figure 5:
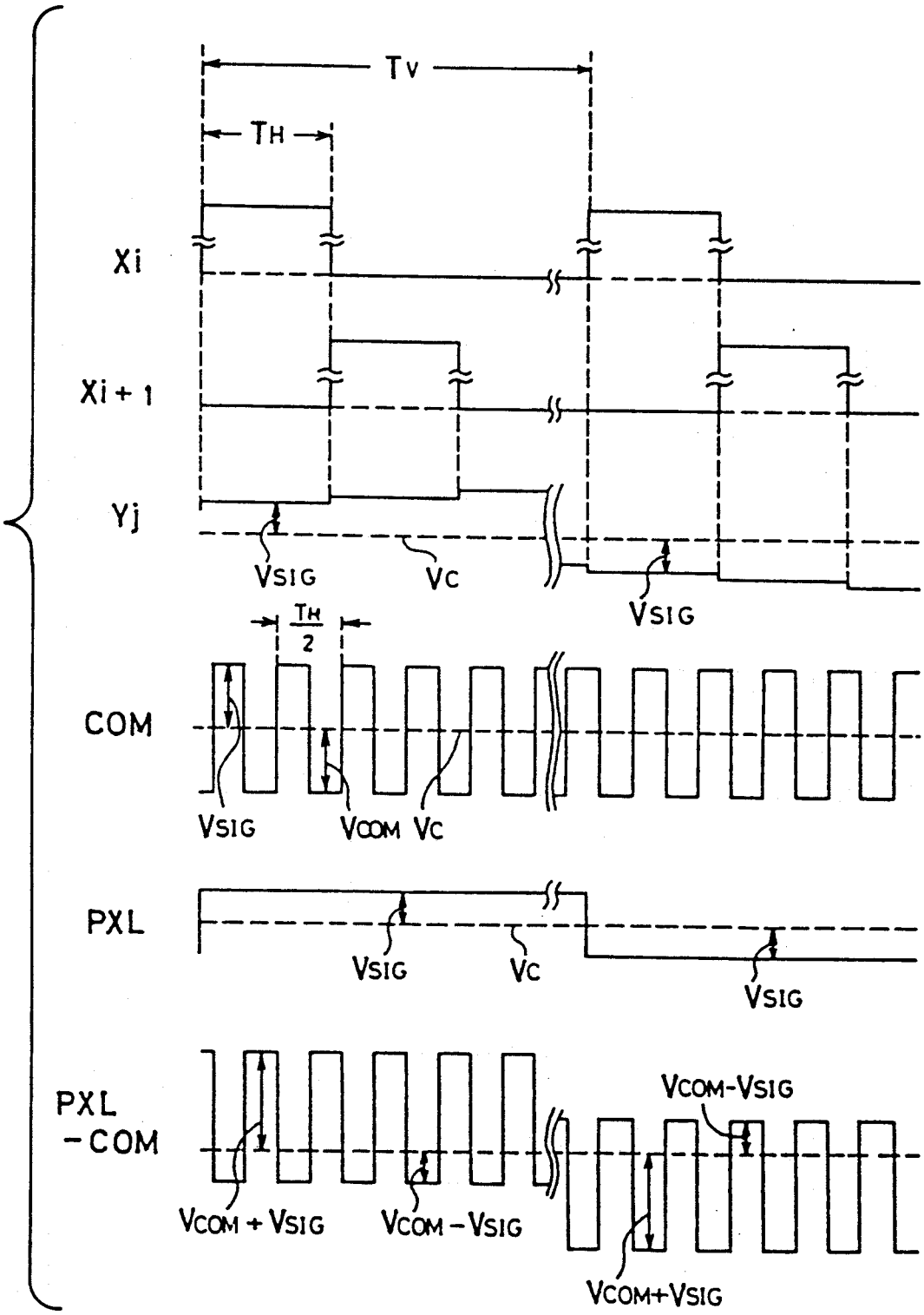
FIG. 5 is a time chart showing waveforms of signals according to a second embodiment of the present invention.

FIG. 5 is a time chart showing a second embodiment according to the present invention. In this embodiment, the alternating period of the common voltage COM is set to one half the horizontal interval $T_H$. The transmittance characteristic of the liquid crystal layer is identical with that of the first embodiment shown in FIG. 2, and the same effects as those of the first embodiment are obtained.

EMBODIMENT 3

Figure 6:
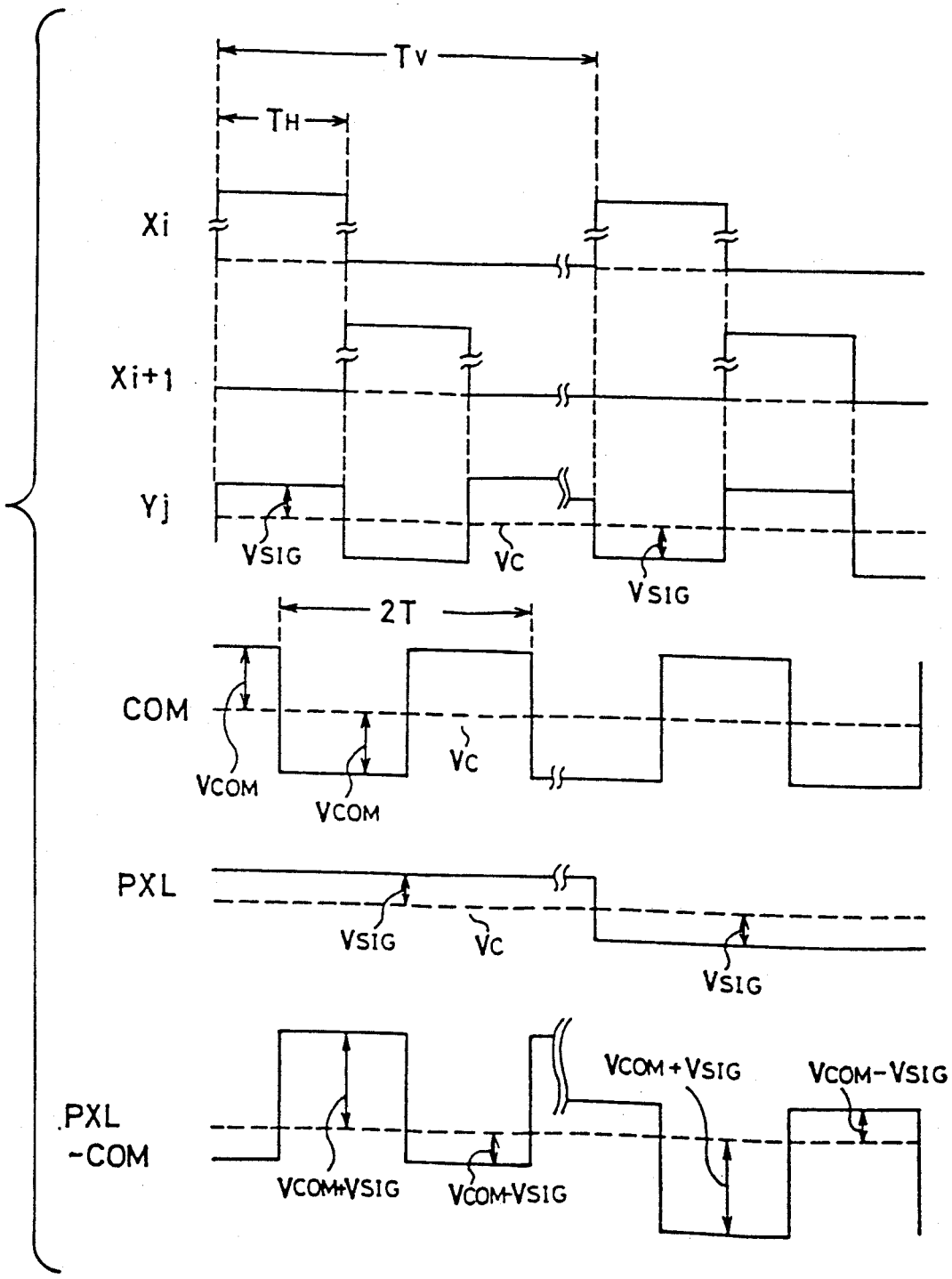
FIG. 6 is a time chart showing waveforms of signals according to a third embodiment of the present invention.

FIG. 6 is a time chart showing a third embodiment according to the present invention. In this embodiment, the alternating period of the common voltage COM is set to two times the horizontal interval $T_H$.

In this embodiment, the picture signal $Y_j$ is inverted about the reference voltage $V_C$ per horizontal interval $T_H$. Where the alternating period of the common voltage COM is set to n times the horizontal interval $T_H$ (n=2, 3, 4 . . . ) as in this embodiment the foregoing point is significant. Of course, the transmittance characteristic of the liquid crystal layer is identical with that of the first embodiment shown in FIG. 2, and the same effects as those of the first embodiment are obtained.

EMBODIMENT 4

Figure 7:
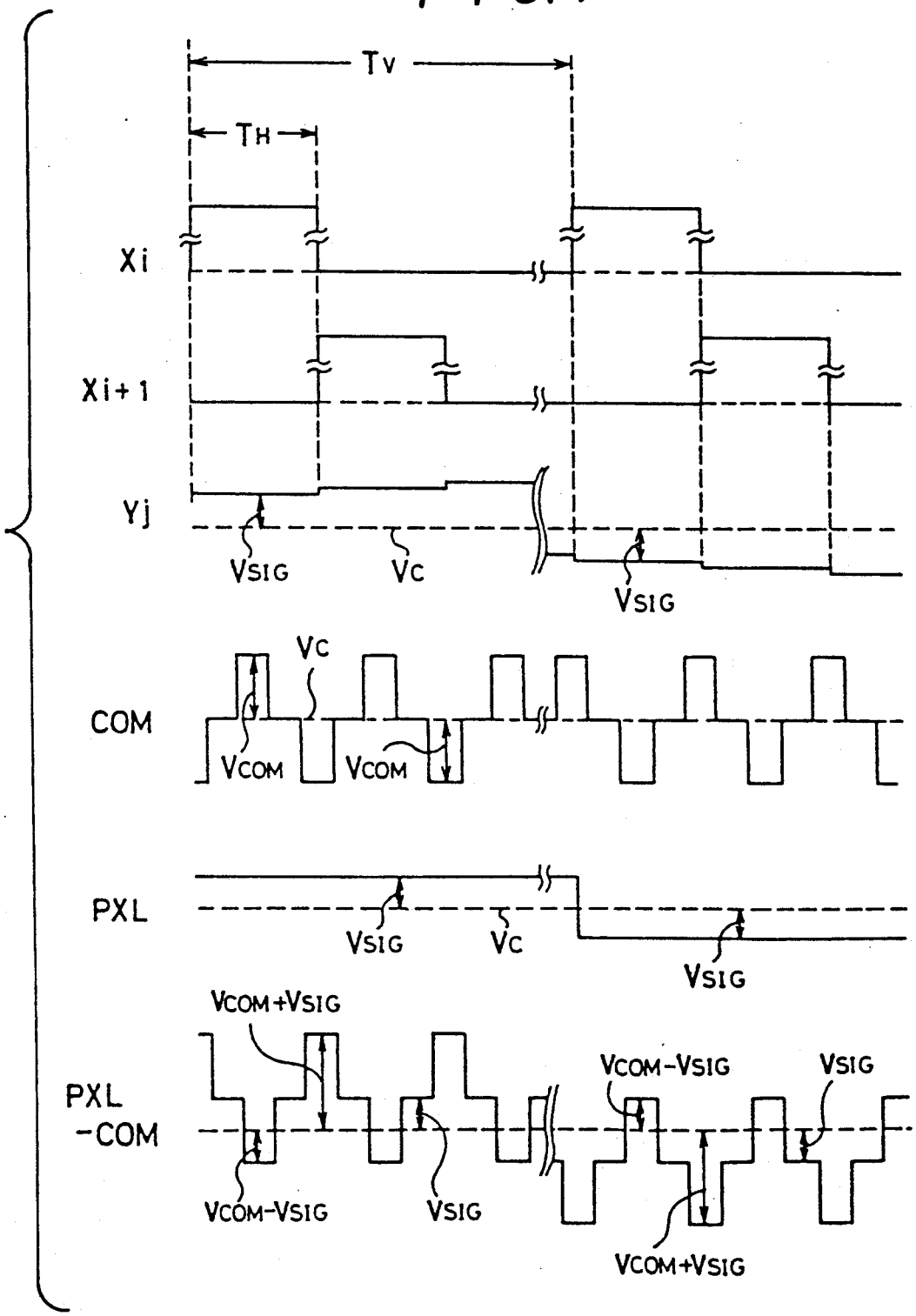
FIG. 7 is a time chart showing waveforms of signals according to a fourth embodiment of the present invention.

FIG. 7 is a time chart showing a fourth embodiment according to the present invention. In this embodiment of the present invention, it is not necessary to make the common voltage COM have a square waveform as in the first, second and third embodiments, but the common voltage may be modified as shown in this drawing. Using the common voltage COM shown in this embodiment, the characteristic of the picture signal voltage $V_{SIG}$ shown in FIG. 2 can be changed to any desired shape to obtain the picture signal $V_{SIG}$ best adapted for the characteristic of the effective voltage $V_{LC}$ applied to the liquid crystal layer.

EMBODIMENT 5

Figure 8:
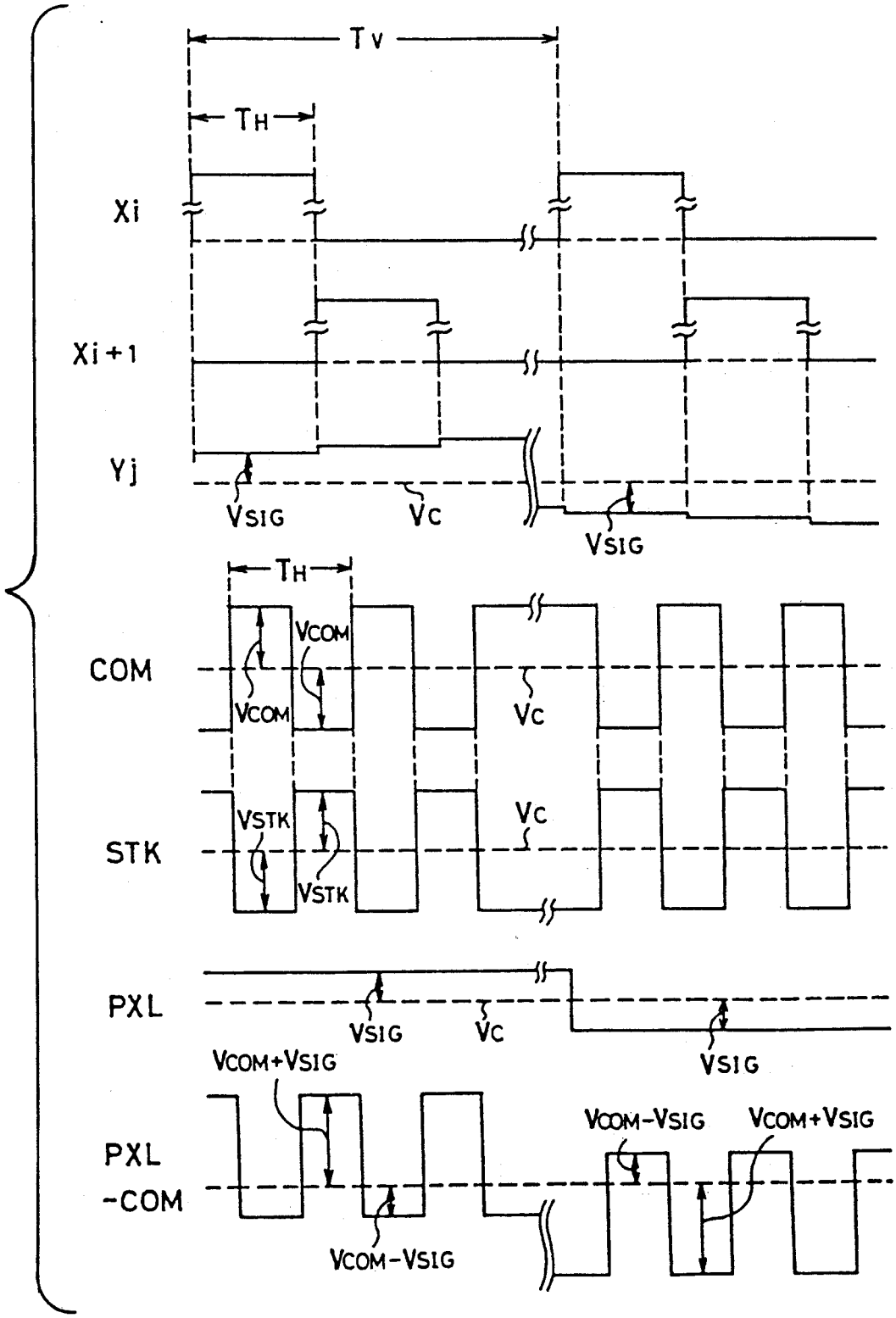
FIG. 8 is a time chart showing waveforms of signals according to a fifth embodiment of the present invention.
Figure 9:
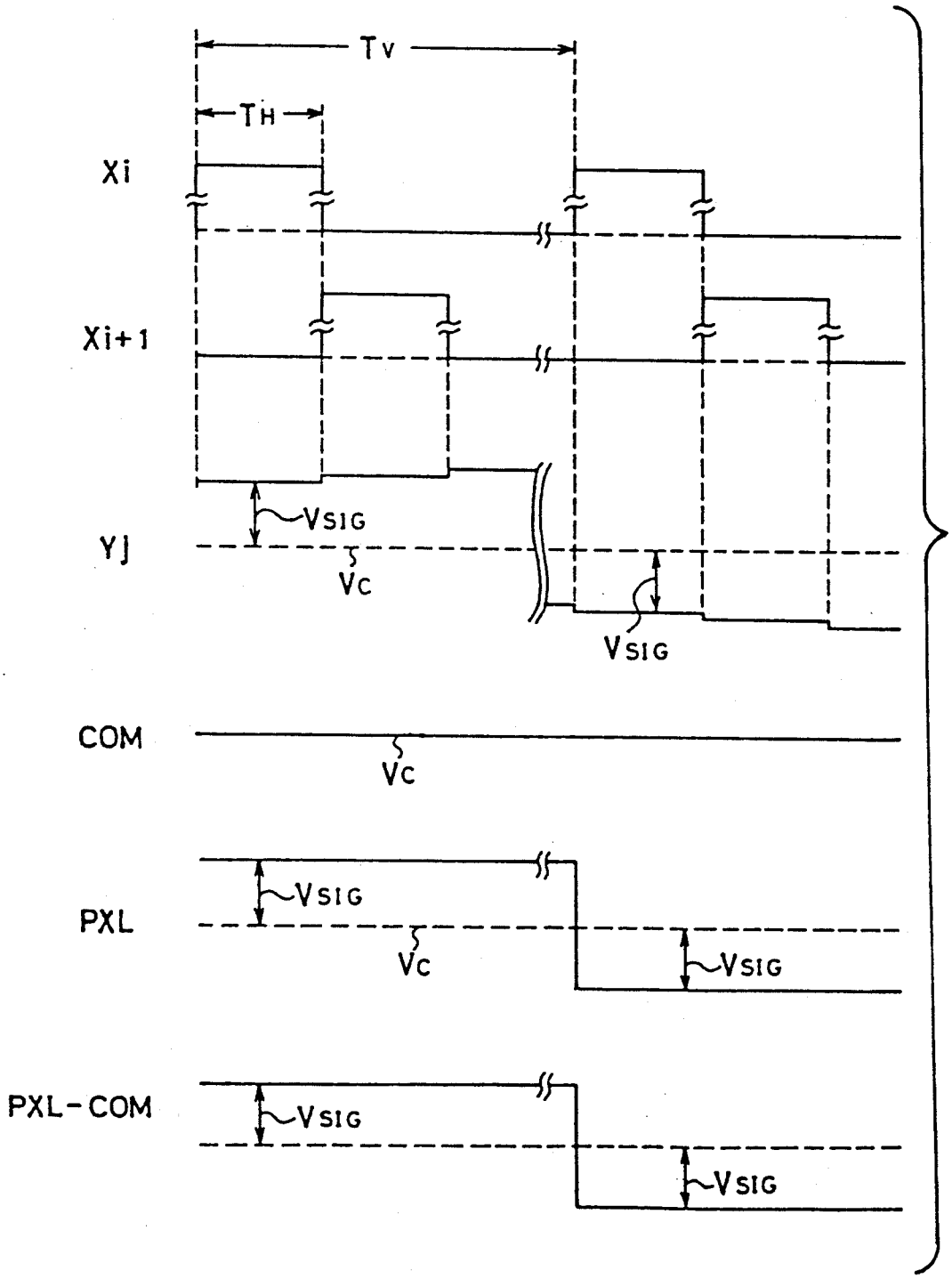
FIG. 9 PRIOR ART
FIG. 9 is a time chart showing waveforms of signals of a conventional system.
Figure 10:
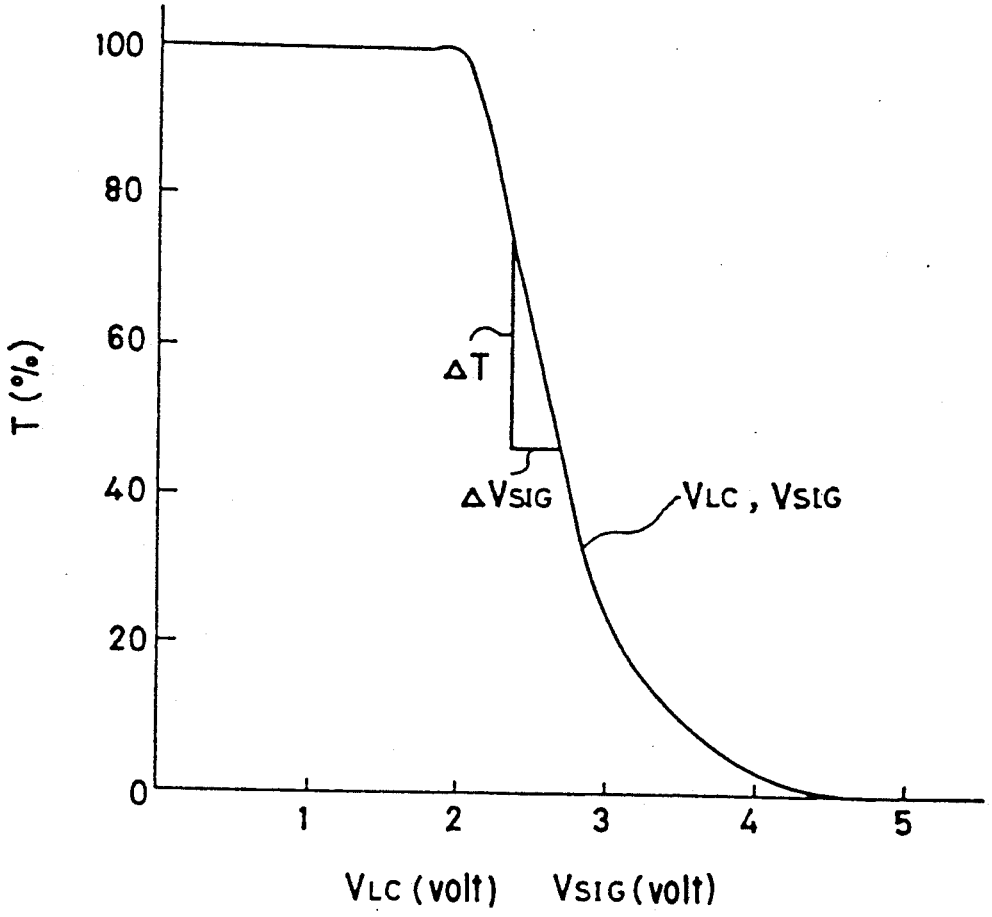
FIG. 10 is a transmittance characteristic graph of a liquid crystal display according to the prior art.

FIG. 8 is a time chart showing a fifth embodiment according to the present invention. This embodiment differs from the foregoing first, second, third and fourth embodiments, that is, the relationship between the capacitance $C_{LC}$ of the liquid crystal layer and the capacitance $C_{ST}$ of the stick capacitor is different from the case of $C_{LC} << C_{ST}$ of the first embodiment. Specifically, concurrently with the addition of an alternating voltage to the common voltage COM, an alternating voltage is added also to the stick capacitor voltage STK. In this case, it is preferable to keep the pixel voltage PXL unchanged, i.e., $\Delta V_{PX}=0$ in expression (1).

This embodiment shows the case where the capacitance $C_{LC}$ of the liquid crystal layer is equal to the capacitance $C_{ST}$ of the stick capacitor ($C_{LC}=C_{ST}$). In this case, the condition of $\Delta V_{PX}=0$ in expression (1) is satisfied if the amplitude $V_{COM}$ of the common voltage COM is equal to the voltage amplitude $V_{STK}$ of the stick capacitor electrode ($V_{COM}=V_{STK}$) and their alternating phases are opposite.

By obtaining the voltage PXL-COM applied to the liquid crystal layer on the basis of the foregoing condition, it will be recognized that the same operation as that of the first embodiment results as shown in the drawing. Therefore, the transmittance characteristic of the liquid crystal layer is identical with that of the first embodiment shown in FIG. 2, and the same effects as those of the first embodiment are obtained.

Even when the condition $C_{LC}=C_{ST}$ is not met, it is preferable to make the common voltage COM and the stick capacitor voltage STK opposite in phase and to modify these voltages so as to meet the following relationship:

$$V_{COM} > V_{STK} \text{ when } C_{LC} < C_{ST}$$

$$V_{COM} < V_{STK} \text{ when } C_{LC} > C_{ST}.$$

It should be noted that the present invention is not necessarily limited to the foregoing embodiments, but may be modified to a system in which an alternating voltage is added to the common voltage COM and/or the stick capacitor voltage STK such that the ratio of the change in liquid crystal light transmittance $\Delta T$ to the change in picture signal voltage $\Delta V_{SIG}$ is smaller than the ratio of the change in liquid crystal light transmittance $\Delta T$ to the change in effective voltage applied to the liquid crystal layer $\Delta V_{LC}$, over a given range of light transmittance T.

In this case, it is preferable that the period of the alternating voltage be no longer than the period of the vertical interval $T_V$. The reason is that if the alternating period is longer than the period of the vertical interval, flicker or the like appears in the display.

Figure 4:
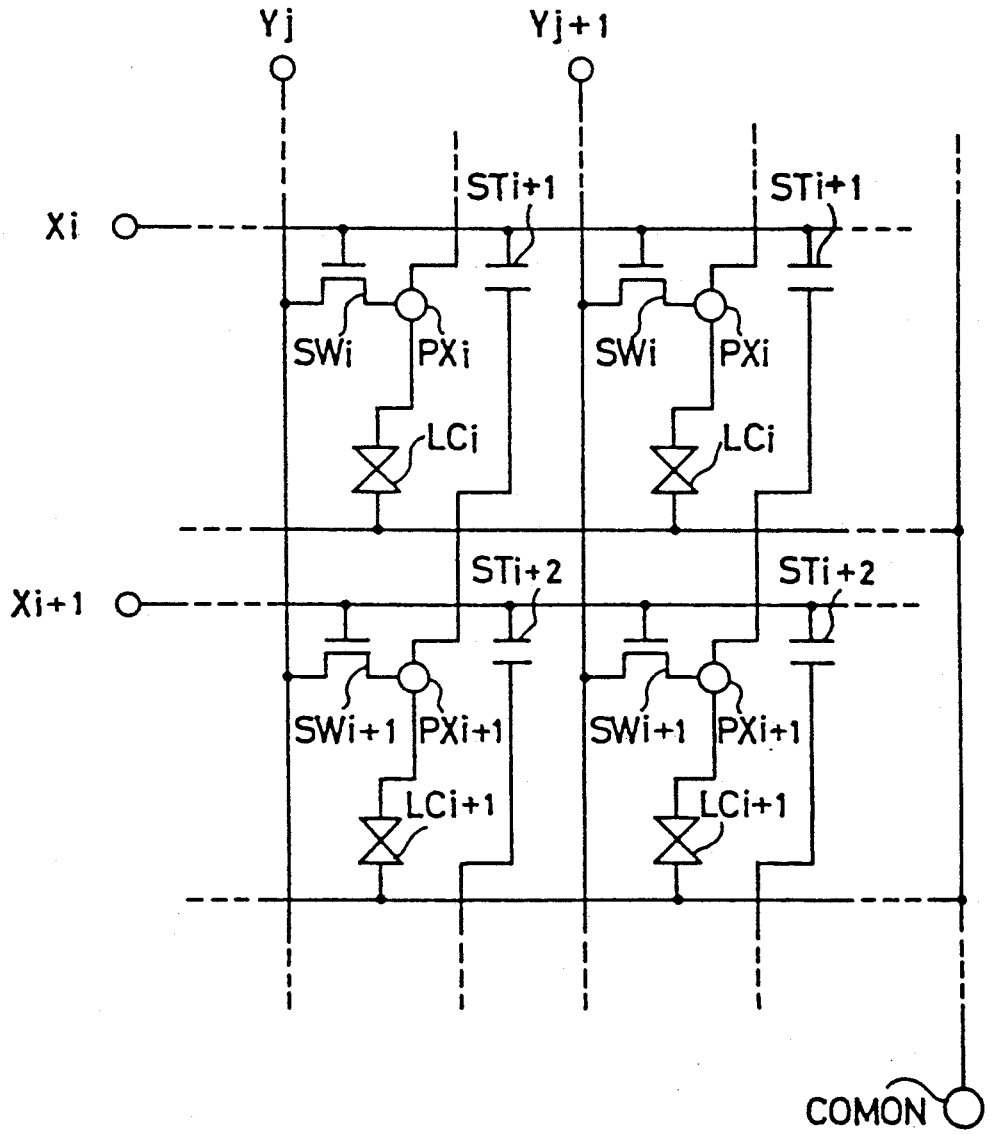
FIG. 4 is an electric circuit diagram showing a portion of another active matrix type liquid crystal display unit with which the present invention can be used.

The circuit usable in the present invention may be configured as shown in FIG. 4, as well as that shown in FIG. 3.

In the circuit of FIG. 4, the stick capacitors $ST_{i+1}$, $ST_{i+2}$ are provided between the pixel electrodes $PX_{i+1}$, $PX_{i+2}$ (not shown) and the scanning signal lines $X_i$, $X_{i+1}$. Therefore, by considering the scanning signal lines $X_i$, $X_{i+1}$ as the stick capacitor electrodes, the foregoing embodiments can be applied without modification.

Further, according to the present invention, since an alternating voltage identical in frequency with the alternating voltage for the common voltage COM/stick capacitor voltage STK is applied to the liquid crystal layer, the domain of the liquid crystal observed in the prior art is reduced, whereby the quality of display can be enhanced.

Since the ratio of the change in light transmittance of the liquid crystal layer $\Delta T$ to the change in picture signal voltage $\Delta V_{SIG}$ can be made small, a sufficient gradational display can be attained to enhance the quality of display.

Further, since the domain of the liquid crystal is reduced, the quality of display is enhanced.

What we claim is:

1. In a method for improving the gradational display of an active type liquid crystal display device of the type including a plurality of liquid crystal layers, a plurality of switching elements, a plurality of pixel electrodes each connected between a respective one of said liquid crystal layers and a respective one of said switching elements, a common electrode connected to the liquid crystal layers, a plurality of stick capacitive elements each connected to a respective one of said pixel electrodes, and a plurality of scanning lines each connected to respective ones of said switching elements, the improvement for use for a gradational display comprising the steps of:

a) selectively turning on said switching elements by applying selection signals to said scanning signal lines of said active type liquid crystal display;

b) supplying picture signals to picture signal lines connected to said pixel electrodes through said switching elements; and c) providing an alternating voltage that changes polarity within each vertical interval period as at least one of:

i) a common voltage at said common electrode, and ii) a stick capacitor voltage supplied to said capacitive elements, wherein the ratio of a change in liquid crystal light transmittance to a change in picture signal voltage is smaller than the ratio of the change in liquid crystal light transmittance to a change in effective voltage applied to a respective said liquid crystal layer.

2. A method according to claim 1, wherein said step of providing an alternating voltage includes the application of said alternating voltage as an integral multiple of a horizontal interval of a picture frame.

3. A method according to claim 1, wherein said step of providing an alternating voltage includes the application of said alternating voltage as an integral fraction of a horizontal interval of a picture frame.

4. A method according to claim 1, wherein said step of providing an alternating voltage includes the application of said alternating voltage for a period no longer than a vertical interval period of a picture frame.

5. A method according to claim 1, wherein said liquid crystal layers have a capacitance which is much less than the capacitance of said capacitance elements.

6. A method according to claim 1, wherein said ratio of the change in liquid crystal light transmittance to the change in picture signal voltage is approximately one-half the ratio of the change in liquid crystal light transmittance to the change in effective voltage applied to a respective said liquid crystal layer.

7. A method according to claim 1, wherein an alternating voltage is provided as said common voltage at said common electrode.

8. A method according to claim 7, wherein an alternating voltage is also provided as said stick capacitor voltage.

9. A method according to claim 8, wherein said liquid crystal layers have a capacitance which is substantially identical to the capacitance of said capacitance elements.

10. A method according to claim 1, wherein an alternating voltage is provided as said stick capacitor voltage.

11. A method according to claim 1, wherein said alternating voltage has square waveform.

12. A method according to claim 1, wherein said alternating voltage has a waveform other than a square waveform.

13. A method according to claim 1, wherein said capacitive elements are all connected to a common capacitive electrode, and said stock capacitive voltage is provided at said common capacitive electrode.

14. A method according to claim 1, wherein each said capacitive element is connected to a respective said scanning line, and said stick capacitive voltage is provided as said selection signals.

* * * * *